US005537944A

United States Patent [19]

Satoma

[11] Patent Number: 5,537,944

[45] Date of Patent: Jul. 23, 1996

[54] STOPPING APPARATUS FOR A SEWING MACHINE

[75] Inventor: Shiro Satoma, Tokyo, Japan

[73] Assignee: Juki Corporation, Tokyo, Japan

[21] Appl. No.: 430,447

[22] Filed: Apr. 14, 1995

[30] Foreign Application Priority Data

Apr. 14, 1994 [JP] Japan ..... 6-075993

[51] Int. Cl.[6] ..... D05B 69/24

[52] U.S. Cl. ..... 112/275

[58] Field of Search ..... 112/275, 277, 112/220, 221, 197, 162

[56] References Cited

U.S. PATENT DOCUMENTS 4,981,096 1/1991 Orii et al. ..... 112/275

5,088,429 2/1992 Kanegae ..... 112/275

5,315,943 5/1994 Sonoda ..... 112/277 X

FOREIGN PATENT DOCUMENTS 59-36553 9/1984 Japan ..... 112/275

*Primary Examiner*—Peter Nerbun

*Attorney, Agent, or Firm*—Morgan, Lewis and Bockius

[57] ABSTRACT

A sewing machine includes a sewing needle, a lower looper, a motor for driving the sewing machine, and a controller for controlling the driving and stopping of the motor. When, in the sewing machine, the controller operates to stop the motor, stop control means operates to stop the motor such that said sewing needle is stopped at a time corresponding to the time just before the sewing needle reaches the bottom dead point and to the time that a needle thread disengages from the sharp tip of the lower looper.

10 Claims, 6 Drawing Sheets

STOPPING APPARATUS FOR A SEWING MACHINE

BACKGROUND OF THE INVENTION

1. Field of the Invention

This invention relates to an apparatus for stopping a sewing machine which facilitates the removal of a thread used for double chain stitches or covering chain stitches (hereinafter referred to as "a stopping apparatus", when applicable).

2. Discussion of the Related Art

Sewing machines such as a lock stitching machine, an overedge stitch machine, and a double chainstitching machine are available in the art. In addition, an over-lock machine is known in the art which selectively forms overedge stitches, double chain stitches and covering chain stitches. A so-called "interlock machine" is also known in the art which is able to form overedge stitches and double chain stitches simultaneously.

With the interlock machine, a free loop can be pulled out. Hence, by cutting the free loop, the fabric can be readily removed from the sewing machine.

On the other hand, a sewing machine which uses more than one sewing needle and only one lower looper thread to form double chain stitches (such as a sewing machine forming a welt seam with no upper decoration: a so-called "single-side covering chain stitching machine"), cannot form a free loop stitch. Hence, with the sewing machine, it is necessary to remove the fabric before a loop is stitched.

However, the conventional sewing machine which uses more than one sewing needle and only one lower looper thread to form a double chain stitches suffers from the following difficulty. After a predetermined sewing operation, such as an overedge stitching operation, the fabric is removed when the needle bar is located near the top dead point. However more than one needle threads are engaged with the lower looper, which greatly resists the removal of the fabric. In this case, at worst the needle threads may be cut off.

SUMMARY OF THE INVENTION

In view of the foregoing, an object of the invention is to provide an apparatus for stopping a sewing machine which uses more than one needle and only one lower loopper thread to form a double chain stitches, which, after a sewing operation, prevents the needle thread from being caught by the sharp tip of the lower looper so that the fabric can be readily removed being less resisted by the thread.

Another object of the invention is to provide an apparatus for stopping a sewing machine which uses more than one sewing needle and only one lower looper thread to form double chain stitches which, after an overedge stitching operation, allows the fabric to be readily removed, and which, in a double chainstitching operation, prevents the needle thread from being caught by the sharp tip of the lower looper so that the fabric can be readily removed being less resisted by the threads.

The first aspect of the present invention provides an apparatus for stopping a sewing machine operating a double chain stitching operation and a covering chain stitching operation, the sewing machine including, a sewing needle, a lower looper, an electric motor for driving the sewing machine and a controller for controlling the driving and stopping of the motor, the apparatus which comprises:

stop control means for stopping the motor such that the sewing needle is brought to a stop position in substantially coincidence with release of the thread from a point of the lower looper just prior to the sewing needle being short of a bottom dead point during the period of time when the controller is operated to stop the motor.

The second aspect of the invention provides the apparatus according to the first aspect, further comprising: reverse rotation control means, after the motor is stopped by the stop control means, for rotating the motor in the reverse direction until the sewing needle is returned near to the top dead point thereof.

The third aspect of the invention provides an apparatus for stopping a sewing machine, the sewing machine including a sewing needle, an upper looper, a lower looper, an electric motor for driving the sewing machine, a controller for controlling the driving and stopping of the motor, and switching means for choosing between an overedge stitching operation which is performed by driving the sewing needle and the upper and lower loopers and a double chainstitching operation or a covering chain stitching operation which is performed by driving the sewing needle and the lower looper, the apparatus which comprises:

stop position selecting means for generating a first stop position signal in the overedge stitching operation, and a second stop position signal in the chain stitching operation, respectively; and stopping means for stopping the motor such that the stop control means receives the first stop position signal from the stop position selecting means to bring the sewing needle to a first position where it is located and stopped adjacent a top dead point in the overedge stitching operation when said controller is operated to stop in association with operation of the switching means, and the stop control means receives the second stop position signal from the stop position selecting means to bring the sewing needle to a second position in substantially coincidence with release of the thread from a point of the lower looper just prior to the sewing needle being short of a bottom dead point during the period of time when the controller is operated to stop the motor in the chain stitching operation during the period of time when the controller is operated to stop in association with operation of the switching means.

The fourth aspect of the invention provides the apparatus according to the third aspect, further comprising:

reverse rotation control means, in the double chainstitching operation or covering chain stitching operation, for rotating the motor in the reverse direction after the motor is stopped by the stop control means until the sewing needle is returned near to the top dead point thereof.

According to the apparatus for stopping the sewing machine of the first aspect, the stop control means operates as follows: When controller is operated to stop the motor, the stop control means stops the motor in such a manner that the sewing needle is stopped at the time instant which corresponds to the time instant that the sewing needle is located before the bottom dead point thereof and which is substantially coincident with the time instant that the needle thread is disengaged from the sharp tip of the lower looper. Hence, when, after the sewing operation, the fabric is taken out, the needle thread is never caught by the sharp tip of the lower looper. Thus, the fabric can be readily removed being less resisted by the threads.

According to the apparatus of the second aspect, after the motor has been stopped the reverse rotation control means rotates the motor in the reverse direction so that the sewing needle is returned near to the top dead point. That is, the sewing needle is automatically returned near to the top dead point, which facilitates the removal of the fabric.

According to the apparatus of the third aspect, when the controller is operated to stop the motor in association with operations such as the switching operation of the switching means, the stop control means operates as follows.

In the case of the overedge stitching operation, the stop control means stops the motor in such a manner that the sewing needle is stopped near the top dead point. Hence, after the overedge stitching operation, the fabric can be readily removed.

In the case of the double chainstitching operation or the covering chain stitching operation, after the motor is stopped so that the sewing needle is stopped at the time instant which corresponds to the time instant that the sewing needle is located before the bottom dead point and which is substantially coincident with the time instant that the needle thread is disengaged from the sharp tip of the lower looper, the sewing machine is rotated in the reverse direction. Hence, when, after the double chainstitching operation or the covering chain stitching operation, the fabric is taken out, the needle thread is never caught by the sharp tip of the lower looper. Therefore, the fabric can be readily removed being less resisted by the threads.

According to the apparatus of the fourth aspect, the reverse rotation control means operates as follows: in the double chainstitching operation or covering chain stitching operation, it rotates the motor in the reverse direction which has been stopped by the stop control means so that the sewing needle is returned near to the top dead point thereof. That is, the sewing needle is automatically returned near to the top dead point, so that the fabric can be readily removed.

BRIEF DESCRIPTION OF THE DRAWINGS

FIG. 1 is a perspective view of the sewing machine with a second work stand set on it for a double chainstitching operation or covering chain stitching operation;

FIG. 4A is a plan view showing the locus which the lower looper describes with respect to the two sewing needles when the sewing machine is in operation, and FIG. 4B is a plan view showing the locus which the lower looper describes when the sewing machine is stopped and rotated in the reverse direction;

FIG. 5A is a side view showing the loop of the needle thread which is formed when, during the reverse rotation of the sewing machine, the sewing needle crosses the lower looper, being moved upwardly from the bottom dead point; and FIG. 5B is a side view showing the loop of the needle thread which is caused to cross the lower looper when the sewing machine is rotated in the reverse direction soon after the disengagement of the needle thread from the lower looper;

DETAILED DESCRIPTION OF THE PREFERRED EMBODIMENTS

An apparatus for stopping a sewing machine according to one embodiment of the invention, will be described with reference to FIGS. 1 through 10.

Figure 1:
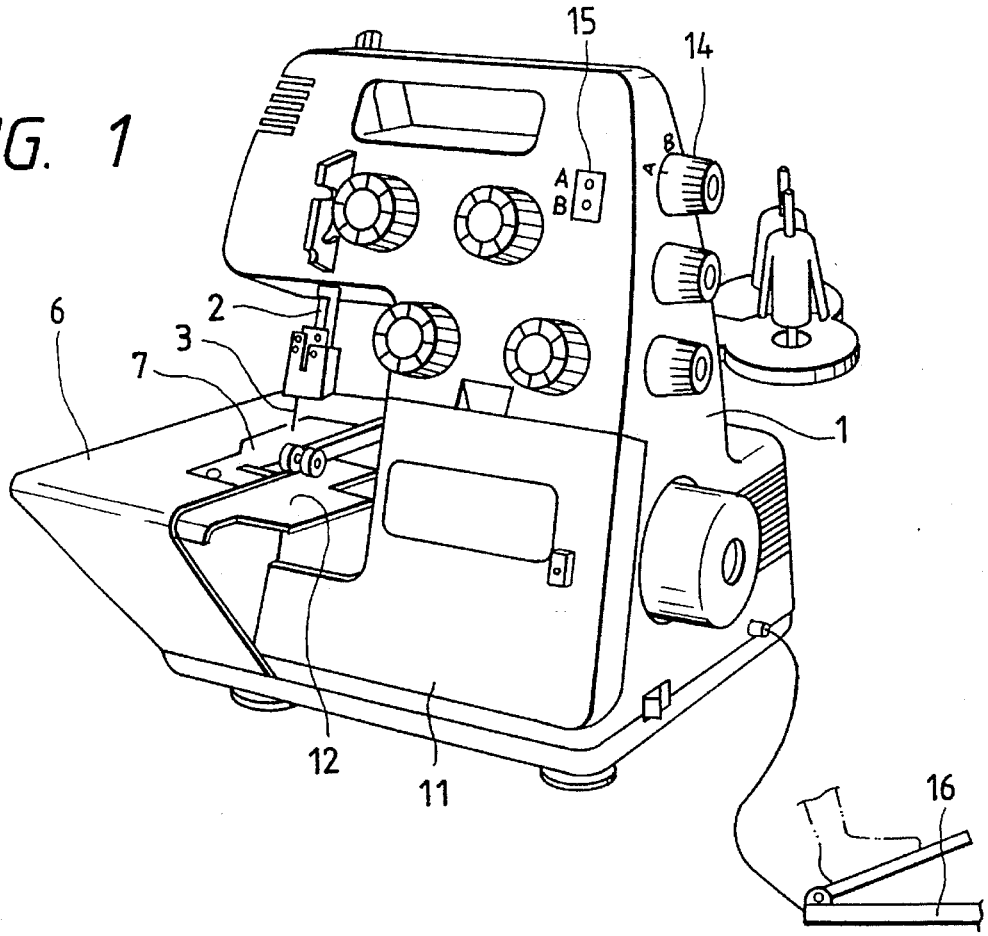
FIG. 1 shows an external appearance of an example of a sewing machine according to the present invention; More specifically.
Figure 2:
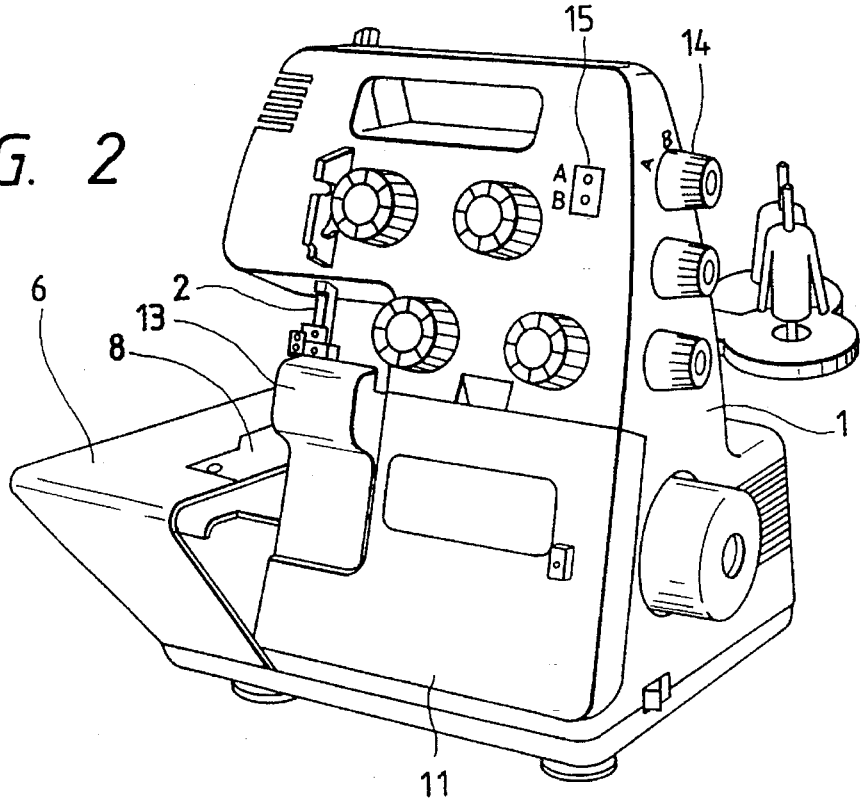
FIG. 2 is a perspective view of the sewing machine shown in FIG. 1 to which a waste-cloth cover is attached.
Figure 3:
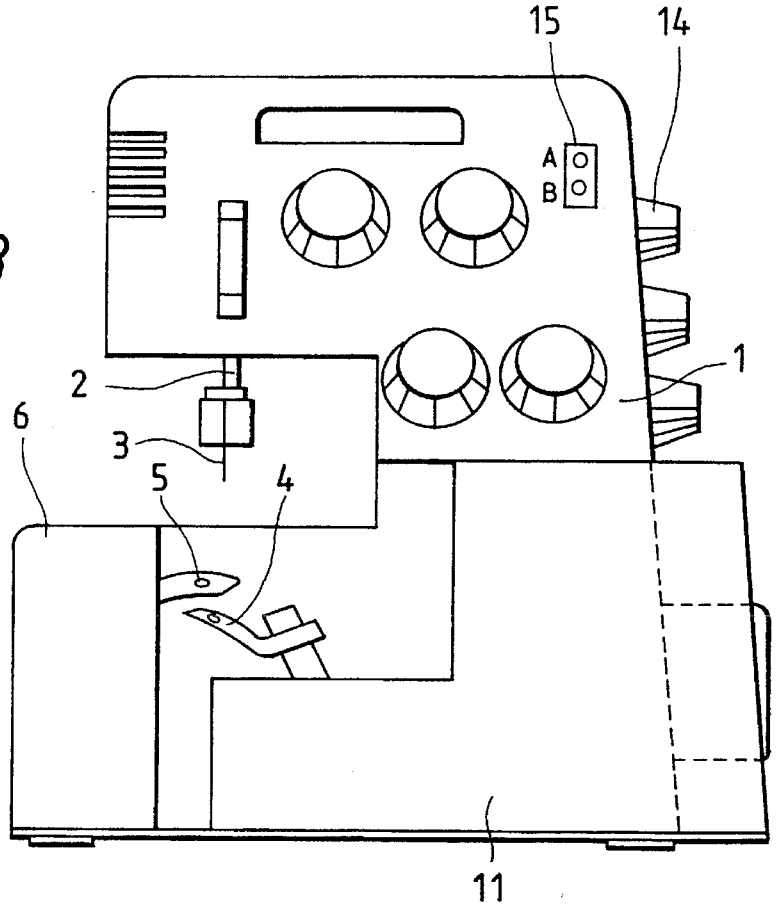
FIG. 3 is a front view of the sewing machine in which a looper cover is opened with the second work stand and the waste-cloth cover being not set.

FIGS. 1 through 3 show external appearances of an example of the sewing machine to which the technical concept of the invention is applied. In those figures, reference numeral 1 designates a sewing machine frame; 2, a needle bar; 3, a sewing needle; 4, an upper looper; 5, a lower looper; 6, a first work stand; 7, a double chain stitch throat plate; 8, an overedge stitch throat plate; 11, a looper cover; 12, a second work stand; 13, a waste-cloth cover; 14, switching means; 15, switching displaying means; and 16, a controller (or a foot pedal).

In the sewing machine, as shown in FIGS. 1 through 3, the needle bar 2 is secured to the head section of the sewing machine frame 1, and the sewing needle 3 is attached to the lower end portion of the needle bar 2, and the upper looper 4 and the lower looper 5 and the first work stand 6 are provided in the lower portion of the sewing machine frame 1. The double chain stitch throat plate 7 or the over casting throat plate 8 is selectively set on the work stand 6. As is well known in the art, the upper looper 4 performs a predetermined sewing operation above the work stand 6, and the lower looper 5 performs a predetermined sewing operation below the work stand 6.

In order to cover the upper looper 4 and the lower looper 5, the add horizontally slidable looper cover 11 is mounted on the front of the lower portion of the sewing machine frame 1. The second work stand 12 used in combination with the double chain stitch throat plate 7, and the waste-cloth cover 13 used in combination with the overedge stitch throat plate 8 are attached to the looper cover 11 independently of each other.

In order to switch the stitching operation, a change-over switch serving as the switching means 14 (hereinafter referred to as "a change-over switch 14", when applicable) is provided on one side of the sewing machine frame 1. The change-over switch 14 is a dial type for switching between a double chainstitching operation A and an overedge stitching operation B over to each other. The displaying means 15 is provided in the upper portion of the front of the sewing machine frame 1, to display a stitching operation selected with the change-over switch 14. In the displaying means 15, a display lamp A is turned on when the double chainstitching operation is selected; and a display lamp B is turned on when the overedge stitching operation is selected.

The sewing machine frame 1 accommodates an electric motor (not shown) as a drive source, a control unit (not shown) for controlling the operation of the motor, a drive mechanism (not shown) between the motor and the needle bar 2, a drive mechanism (not shown) between the motor and the upper looper 4, and a drive mechanism (not shown) between the motor and the lower looper 5. The sewing machine frame 1 is connected to the controller (or foot pedal) 16 which is depressed by the operator to start and stop the motor.

In order to form double chain stitches with the above-described sewing machine, as shown in FIG. 1, the change-over switch 14 is turned to the position A for "double chainstitching operation". The double chain stitch throat plate 8 is set on the work stand 6. The second work stand 12 is coupled to the looper cover 11. Then, the lopper cover 11 is closed. When the double chainstitching operation is selected in the above-described manner, the upper lopper 4 is lowered and stopped at the position where it does not interfere with the second work stand 12. Thus, as the sewing needle 3 is moved up and down while the lower looper 5 is swung, the thread passed through the sewing needle 3 and the looper thread passed through the lower looper 5 form the aimed double chain stitches.

In order to form overedge stitches, as shown in FIG. 2, the change-over switch 14 is turned to the position B for "overedge stitching operation", and the overedge stitch throat plate 8 is mounted on the work stand 6, and the waste-cloth cover 13 is coupled to the looper cover 11. Then, the looper cover 11 is closed. Hence, as the sewing needle 3 is moved up and down while the upper looper 4 and the lower looper 5 are swung, the thread passes through the sewing needle, through the upper looper 4 and through the lower looper 5, thereby forming the aimed overedge stitches.

As shown in the double chainstitching operation using two sewing needles 3 (3L and 3R) of FIG. A4, the lower looper 5 and one looper thread, the lower looper 5 is moved around the right and left sewing needles 3R and 3L describing a substantially elliptic locus. In this case, the lead angle θ of the lower looper 5 is defined 0° (θ=0°) when the lower looper 5 is at the rightmost point; and the lead angle θ is defined 180° (θ=180°) when the lower looper 5 is at the leftmost point (1).

Figure 4A:
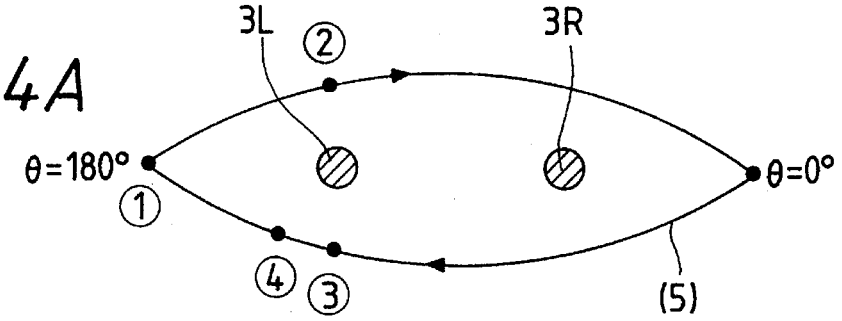
FIGS. 4A and 4B show relationships between two sewing needles and a lower looper in a double chainstitching operation; More specifically.
Figure 4B:
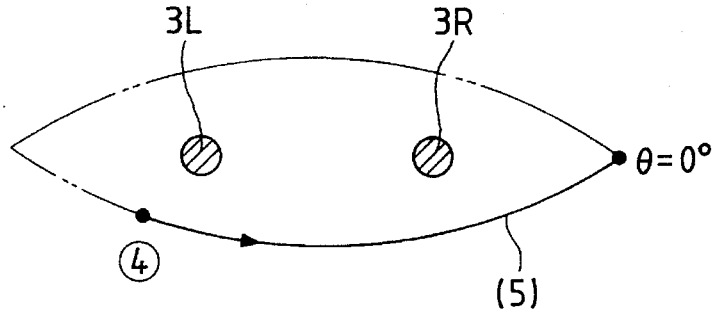
Figure 6:
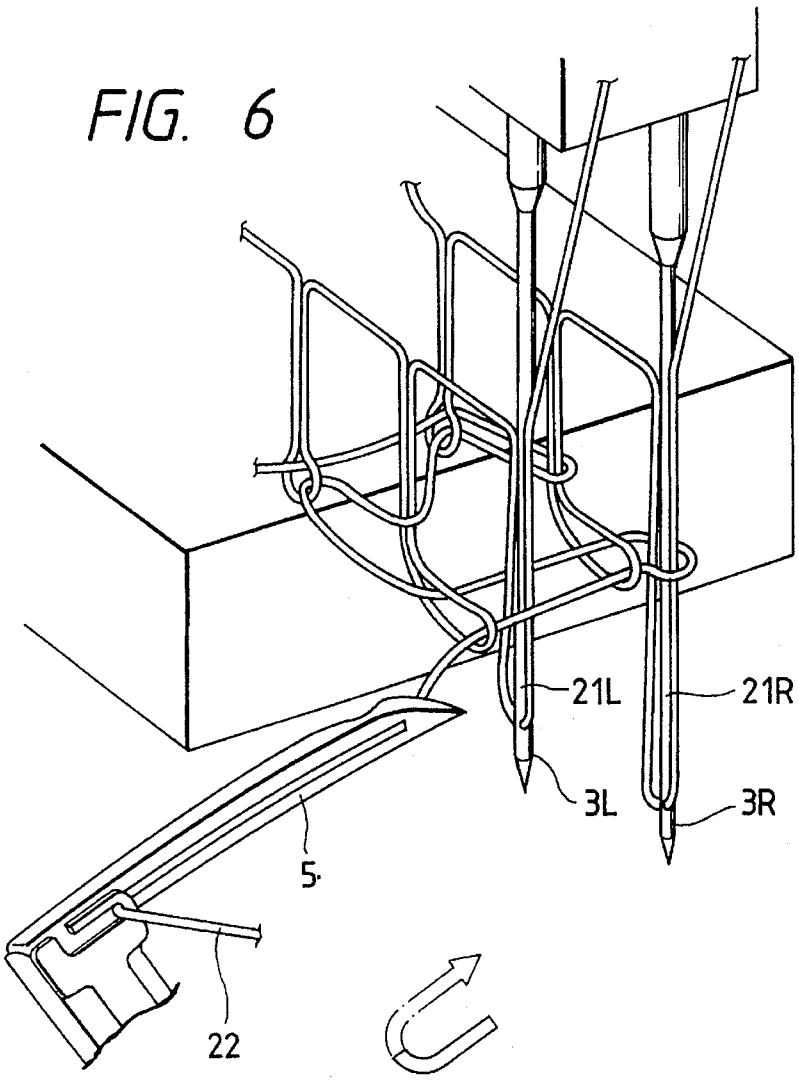
FIG. 6 is a perspective view outlining relationships established between the two sewing needle and the needle thread when the lower looper is located at the position (1) in FIG. 4A.

When the lower looper 5 is moved to the position of θ=180° from the position of θ=0°, i.e., position (1) of FIG. 4A, the needle bar 2 is at its bottom dead point, and as shown in FIG. 6, the right and left needles 3R and 3L are at their bottom dead points. In FIG. 6, reference character 21R designates the right needle thread; 21L, the left needle thread; and 22, a looper thread.

Figure 7:
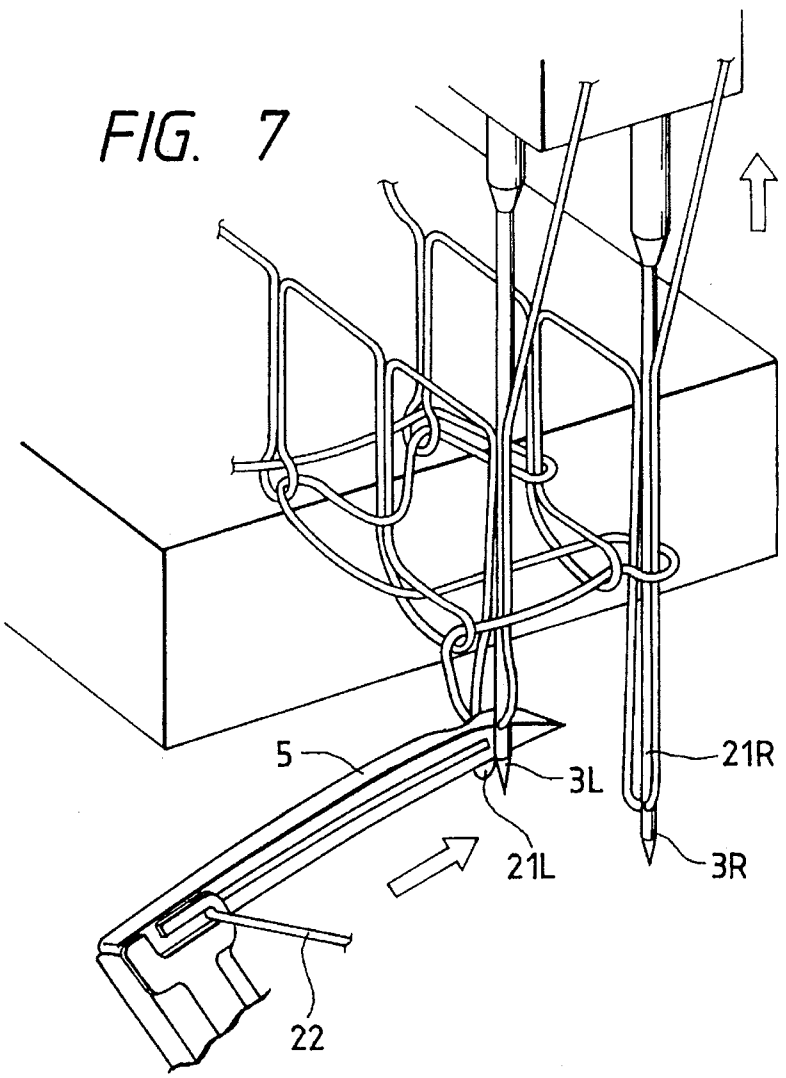
FIG. 7 is a perspective view outlining relationships established between the two sewing needle and the needle thread when the lower looper is located at the position (2) in FIG. 4A.

When the lower looper 5 is moved from the position of θ=180° to the right and comes aside the other side of the left needle 3L to position (2) of FIG. 4A, the needle bar 2 is lifted above the bottom dead point, and, as shown in FIG. 7 the right and left needles 3R and 3L are lifted above the bottom dead points. Also, the sharp tip of the lower looper 5 enters the loop of the left needle thread 21L passing through the left needle 3L. In this case, the lead angle θ of the lower looper 5 is 207° (θ=207°).

When the lower looper 5 is further moved to the right and comes aside the right needle 3R with the lead angle θ=229°. In this operation, the sharp tip of the lower looper 5 enters the loop of the right needle thread 21R passing through the right needle 3R which is further moved upwardly.

Figure 8:
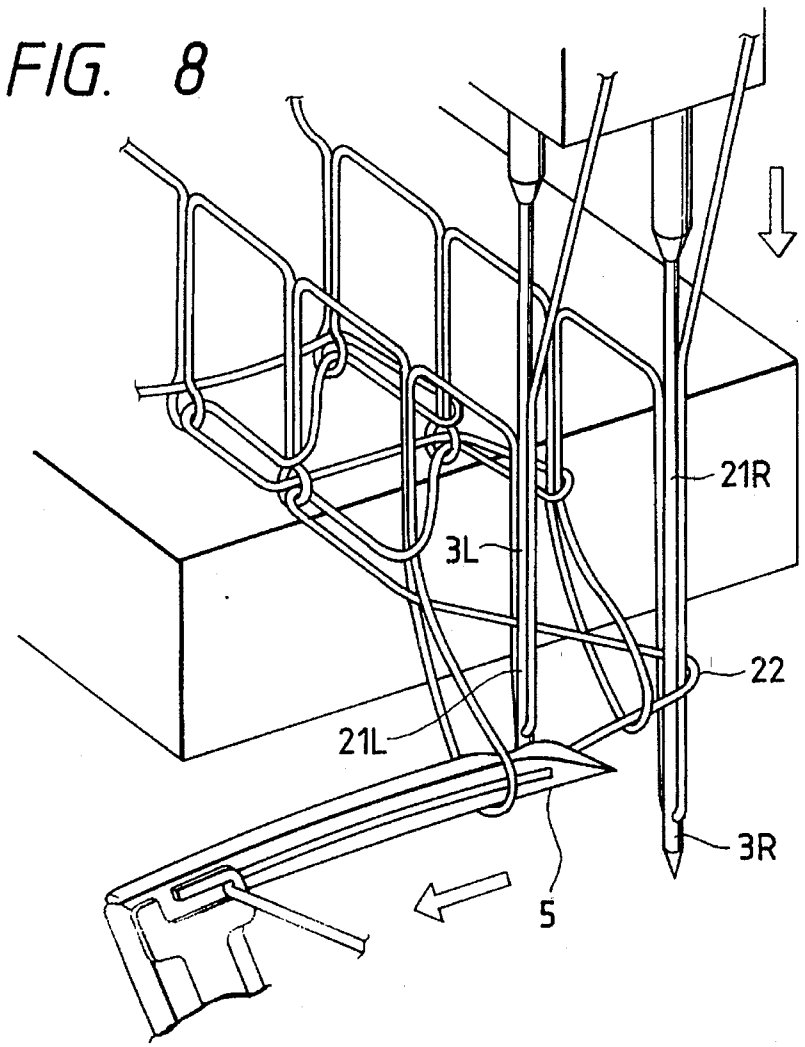
FIG. 8 is a perspective view outlining relationships established between the two sewing needle and the needle thread when the lower looper is located at the position (3) in FIG. 4A.

When the lower looper 5 reaches θ=0° and moves to the left again coming aside the first left needle 3L to position (3) of FIG. 4A, the needle bar 2 is being moved from the top dead point toward the bottom dead point. As shown in FIG. 8, the right needle 3R and the right needle thread 21R are engaged with the looper thread 22, and the left needle thread 21L is engaged with the lower looper 5. The left needle thread 21L disengages from the lower looper 5 at a time corresponding to θ=140°. Before the disengagement of the left needle thread, the right needle thread 21R is disengaged from the lower looper at a time corresponding to θ=125°.

Figure 9:
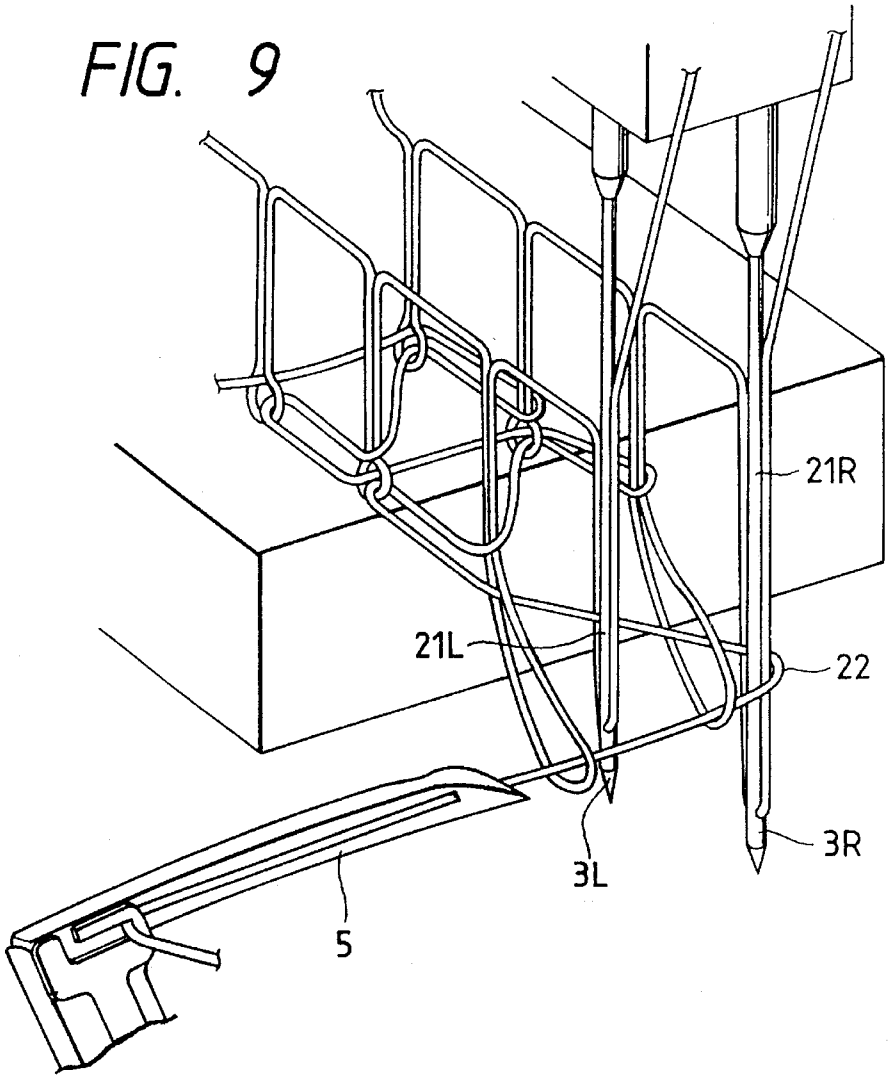
FIG. 9 is a perspective view outlining relationships established between the two sewing needle and the needle thread when the lower looper is located at the position (4) in FIG. 4A and 4B.

When the lower looper 5 is further moved to the left to point (4) of FIG. 4A, the needle bar 2 is located before the bottom dead point, and, as shown in FIG. 9, the sharp tip of the lower looper 5 is disengaged from the left needle thread 21L. After the disengagement, the needle bar 2 reaches the bottom dead point. Thereafter, the above-described operations are repeated.

In the above-described double chainstitching operation, if the sewing machine is stopped (i.e., the motor is stopped) when the needle bar 2 reaches the bottom dead point, the sewing machine is manually rotated in the reverse direction to raise the sewing needle 3. In this case, as shown in FIG. 5A the left needle 3L moves upward from the bottom dead point crossing the lower looper 5, so that the loop of the left needle thread 21L greatly protrudes on this side (the left side in FIGS. 5A and 5B) of the left needle 3L; i.e., on the side of the lower looper 5.

Figure 5A:
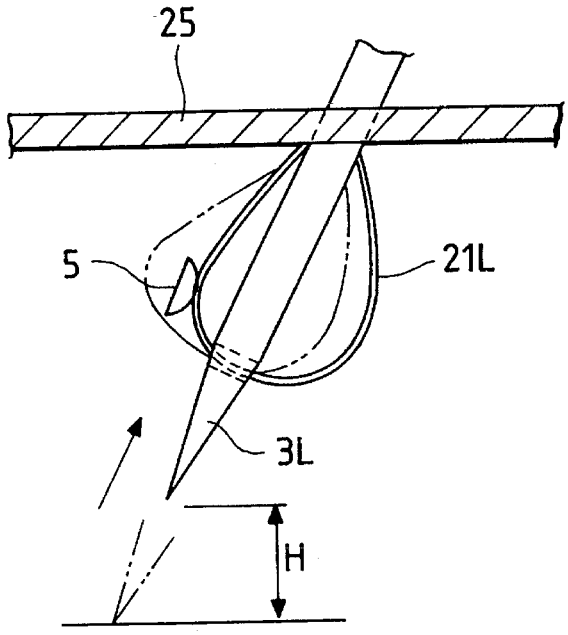
FIGS. 5A and 5B show relationships between a sewing needle, a needle thread, and a lower looper in a double chainstitching operation; More specifically.

At worst, as indicated by the dotted line in FIG. 5A the loop of the left needle thread 21L is caught by the sharp tip of the lower loop 5 making it difficult to remove the fabric 25. In FIG. 5A, reference character H designates the amount of upward movement of the needle bar 2 from the bottom dead point.

Figure 5B:
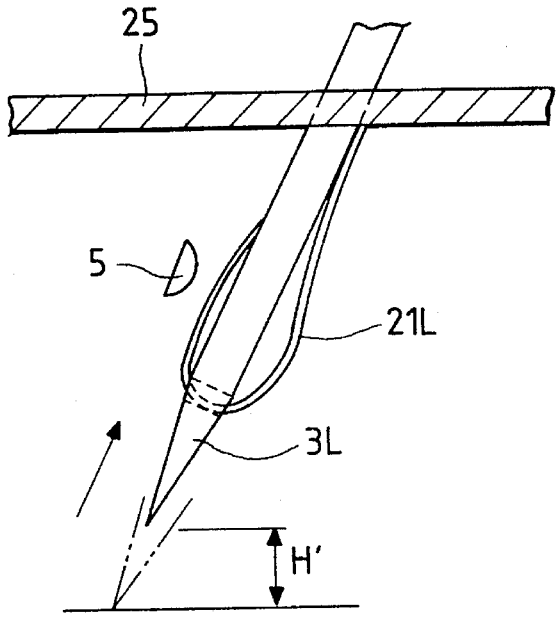

In view of the foregoing, in the invention, soon after the sharp tip of the lower looper 5 disengages from the left needle thread 21L as shown in FIG. 9 at a time instant corresponding to position (4) of FIG. 4A, the sewing machine is stopped (i.e., the motor is stopped), and then rotated in the reverse direction. Hence, even if the left needle 3L moves upward crossing the lower looper 5, the sharp tip of the lower looper 5 is prevented from being caught by the loop of the left needle thread 21L. Therefore the fabric 25 can be readily removed. In FIG. 5B, reference character H' denotes the amount of upward movement of the needle bar 2 from the position where it is located within a short time after the disengagement of the left needle thread 21L from the lower looper 5. The amount of upward movement H' is smaller than the above-described amount of upward movement H (H>H').

That is, in order to determine a stop position for the sewing needle 3, a signal is issued at substantially the same time as when the needle thread 21 (the left needle thread 21L) disengages from the sharp tip of the lower looper 5, so that the sewing machine is stopped before the needle bar 2 reaches the bottom dead point. Under this condition, the sewing machine is manually or automatically rotated in the reverse direction. As a result, as shown in FIG. 5B, with the amount H' of upward movement of the needle bar 2 being small, the lower looper 5 crosses the left needle thread 21L. In this case, the loop of the left needle thread 21L, being small, is scarcely protruded towards the lower looper 5 located on this side of the left needle 3L (on the left side of the left needle 3L in FIG. 5B). Hence, the left needle thread 21L is never caught by the sharp tip of the lower looper 5.

Accordingly, the fabric 25 can be readily removed when the needle bar 2 is sufficiently moved upward from the fabric 25; that is, when the needle bar 2 reaches the top dead point. In this case, the fabric 25 is less restrained by the sewing needles 21, so that it can be readily taken out.

In an overedge stitching operation (not shown) using one sewing needle 3, the upper and lower loopers 4 and 5, and two looper threads, the motor is stopped so that the sewing needle 3 is stopped near the top dead point.

Figure 10:
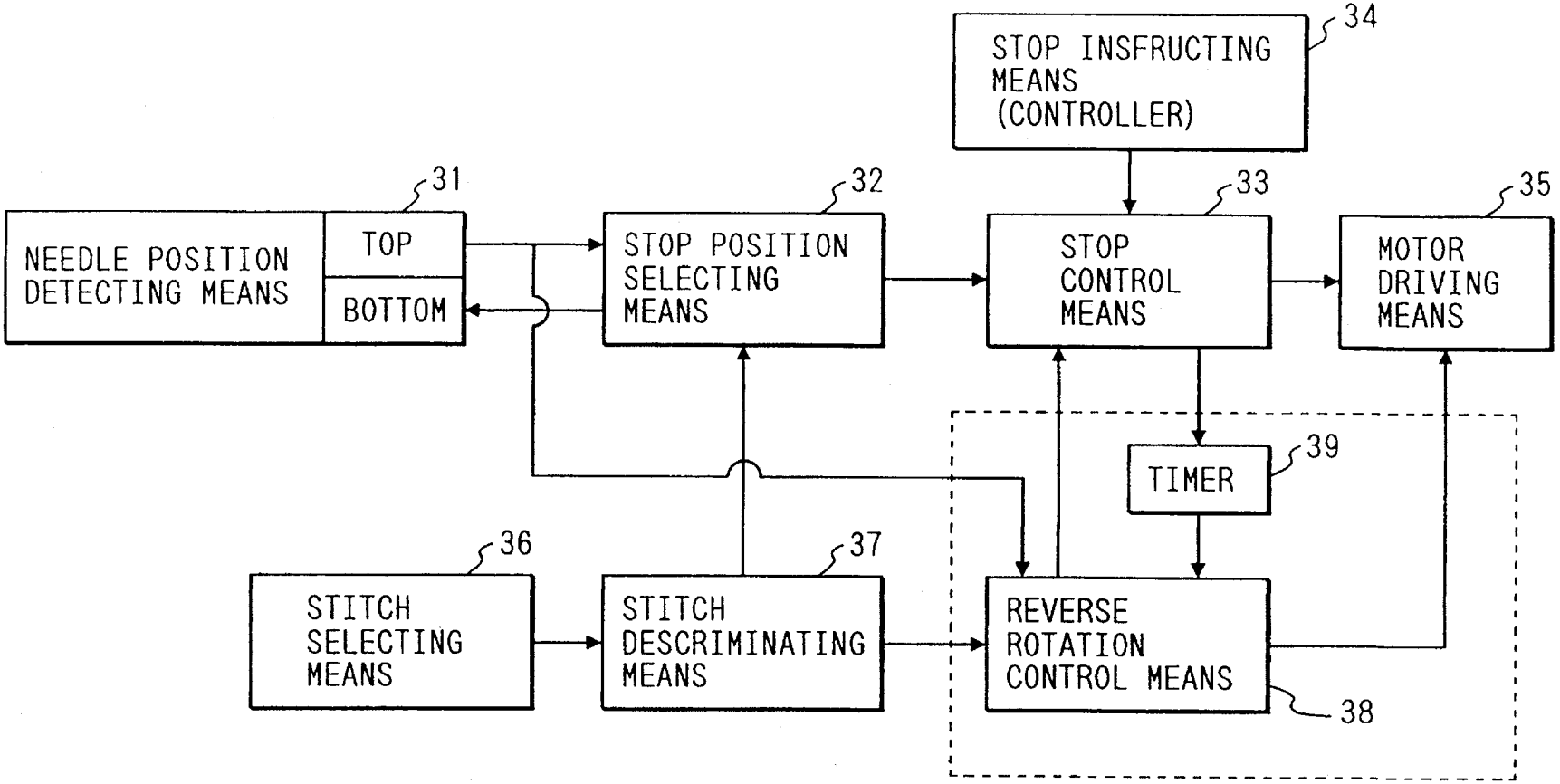
FIG. 10 is a block diagram for a description of an example of a stop control operation according to the invention.

FIG. 10 is a block diagram for a description of an example of a stop control operation according to the invention. In FIG. 10, reference numeral 31 designates needle position detecting means; 32, stop position selecting means; 33, stop control means; 34, stop instructing means (a controller); 35, motor driving means; 36, stitch selecting means; 37, stitch discriminating means; and 38, reverse rotation control means.

The two needle position detecting means 31 applies needle position detection signals to the stop position selecting means 32. One of the position detection signals is a lower position signal representing a lower position located before the needle's bottom dead point corresponding to disengagement of the needle thread 21 from the lower looper 5, and the other signal is an upper position signal representing an upper position near the needle's top dead point. The stop position selecting means 32 applies a stop position signal to the stop control means 33, to which a stop signal is applied by the stop instructing means 34 (the above-described controller 16).

The stop control means 33 applies a stop signal to the motor driving means 35. In response to the stop signal, the motor driving means 35 outputs a stop signal to stop the motor. The stop position signal from the stop position selecting means 32 is fed back to the needle position detecting means 31.

The stitch selecting means 36 applies a stitch selection signal to the stitch discriminating means 37. The stitch discriminating means 37 applies a stitch discrimination signal to the stop position selecting means 32.

Hence, when the change-over switch 14 is turned to the position A of "double chainstitching operation", the stitch selecting means 36 applies a double chain stitch selection signal to the stitch discriminating means 37, and the stitch discriminating means 37 applies a double chain stitch discrimination signal to the stop position selecting means 32. Furthermore stop position selecting means 32 applies a stop position signal to the stop control means 33 which is provided for the double chainstitching operation.

In response to the stop signal from the stop instructing means 34 (the aforementioned controller 16), the stop control means 33 applies a stop position signal to the motor driving means 35 which is provided for the double chainstitching operation. And the motor driving means 35 outputs a stop signal which is provided for the double chainstitching operation. As a result, as indicated by (4) in FIGS. 4A and 4B, the motor is stopped so that the sewing needle 3 is stopped at the time just before the sewing needle 3 is located at the bottom dead point. This is substantially the same time that the needle thread 21 is disengaged from the sharp tip of the lower looper 5.

After being stopped in the above-described manner, the sewing machine is turned in the reverse direction. When the needle bar 2 substantially reaches the top dead point, the fabric 25 is taken out. In this case, the sewing needle 21 does not restrain the fabric, and, therefore, the fabric 25 can be readily pulled out.

When the change-over switch 14 is turned to the position B of "overedge stitching operation", the stitch selecting means 36 applies an overedge stitch selection signal to the stitch discriminating means 37, and the stitch discriminating means 37 applies an overedge stitch discrimination signal to the stop position selecting means 32. Furthermore, the stop selecting means 32 applies a stop position signal to the stop control means 33 which is provided for the overedge stitching operation.

In response to a stop signal from the stop instructing means 34 (the aforementioned controller 16), the stop control means 33 applies a stop position signal to the motor driving means 35 which is provided for the overedge stitching operation. The motor driving means 35 outputs a stop signal which is provided for the overedge stitching operation. As a result, the motor is stopped so that the sewing needle 3 is stopped near the top dead point. Hence, the fabric can be readily pulled out.

In order that in the double chainstitching operation, the sewing machine stopped in the above-described manner is automatically rotated in the reverse direction, the arrangement encircled with the dotted line in FIG. 10 is employed. That is, the reverse rotation control means 38 is provided to which the stitch discriminating means 37 applies a stitch discrimination signal.

Only when the stitch discriminating means 37 applies a double chain stitch discrimination signal to the reverse rotation control means 38, the reverse rotation control means 38 applies a reverse rotation drive signal to the motor driving means 35, and a stop signal to the stop control means 33. Moreover, the stop control means 33 applies a reverse rotation drive signal to the reverse rotation control means 38 through a timer which provides a predetermined time lag.

As described above, after the stop signal from the motor driving means 35 which is provided for the double chainstitching operation stops the motor so that the sewing needle 3 is stopped just before the sewing needle 3 reaches the bottom dead point and substantially at the same time instant that the needle thread 21 is disengaged from the sharp tip of the lower looper 5, the stop control means 33 applies the reverse rotation drive signal to the reverse rotation control means 38 through the timer 39. The reverse rotation control means 38 applies the reverse rotation drive signal to the motor driving means 35.

As a result, the motor is rotated in the reverse direction. When the needle bar 2 substantially reaches the top dead point, the reverse rotation control means applies a stop signal to the stop control means 33, to stop the reverse rotation of the motor. After being stopped in the above-described manner, the sewing machine is automatically rotated in the reverse direction. When the needle bar 2 substantially reaches the top dead point, the sewing machine is stopped again.

The discrimination of stitches, namely, a double chain stitch and an overedge stitch by the stitch discriminating means 37 is based on the switching operation of the change-over switch 14; however, the invention is not limited thereto or thereby. That is, the discrimination of stitches may be based on the operation of a lever which chooses between the drive mechanism of the upper looper 4 and the drive mechanism of the lower looper 5, or on the switching of the double chain stitch throat plate 7 and the overedge stitch throat plate 8.

The invention has been described with reference to the sewing machine adapted to form overedge stitches and double chain stitches; however, it should be noted that the invention is not limited thereto or thereby. That is, the technical concept of the invention may be applied to a sewing machine which is adapted to form overedge stitches and covering chain stitches, or to a sewing machine which is adapted to form double chain stitches and covering chain stitches. The number of sewing needles and the number of sewing threads are not limited to those which have been described above. In addition, it goes without saying that other arrangements and structures may be changed or modified without departing from the invention.

With the stopping apparatus described above, the sewing needle is stopped just before the sewing needle reaches the bottom dead point thereof and substantially at the same time that the needle thread is disengaged from the sharp tip of the lower looper. Hence, when, after the double chainstitching operation or the covering chain stitching operation, the fabric is removed, the needle thread is never caught by the sharp tip of the lower looper. That is, the fabric is less resisted by the threads. Accordingly, the fabric can be readily removed. This feature is effected particularly with a sewing machine which forms double chain stitches by using more than one sewing needle and only one lower looper thread.

Furthermore, the sewing needle is automatically returned to near the top dead point. Hence, the removal of the fabric can be achieved with ease.

With the stopping apparatus described above, when the controller is operated to stop the motor in association with operations such as the switching operation of the switching means, the sewing needle is stopped as follows: In the case of the overedge stitching operation, the sewing needle is stopped near the top dead point. Hence, after the overedge stitching operation, the fabric can be readily removed. In the case of the double chainstitching operation or the covering chain stitching operation, the sewing needle is stopped just before the sewing needle reaches the bottom dead point and at substantially the same time that the needle thread is disengaged from the sharp tip of the lower looper. Hence, after the double chainstitching operation or the covering chain stitching operation, the needle thread is never caught by the sharp tip of the lower fabric is removed. That is, the fabric is less resisted by the threads. Therefore, the fabric can be readily removed. This feature is effected particularly with a sewing machine which forms double chain stitches by using more than one sewing needle and only one lower looper thread.

Furthermore, in a double chainstitching operation or covering chain stitching operation the sewing needle is returned near to the top dead point thereof. Hence, the fabric can be readily removed.

What is claimed is:

1. An apparatus for stopping a sewing machine that performs at least one of a double chain stitching operation and a covering chain stitching operation, said sewing machine comprising a sewing needle, a lower looper, a motor for driving said sewing machine and a motor drive controller for controlling the driving and stopping of said motor, said apparatus comprising:

a stop controller for stopping the motor and for bringing the sewing needle to a stop position in substantial coincidence with release of the thread from a point of the lower looper just prior to the sewing needle reaching a bottom dead point during the period of time when the motor drive controller is operated to stop the motor; and a reverse rotation controller for rotating the motor in the reverse direction after the motor is stopped by said stop controller until the sewing needle is returned at or near to the top dead point of the sewing needle.

2. An apparatus according to claim 1, wherein said reverse rotation controller includes a timer for providing a predetermined time lag.

3. An apparatus according to claim 1, wherein said reverse rotation controller rotates the motor in the reverse direction after the motor is stopped by said stop controller until the sewing needle is returned to near the top dead point of the sewing needle.

4. (Amended) An apparatus for stopping a sewing machine, said sewing machine comprising a sewing needle, an upper looper, a lower looper, a motor for driving the sewing machine, a motor drive controller for controlling the driving and stopping of the motor, and switch selector for selecting between an overedge stitching operation performed by driving the sewing needle and the upper and lower loopers and a chain stitching operation, including at least one of a double chain stitching operation and a covering chain stitching operation performed by driving the sewing needle and the lower looper, said apparatus comprising:

a stop position selector for generating a first stop position signal in the overedge stitching operation, and a second stop position signal in the chain stitching operation, respectively; and a stop controller for stopping the motor when the motor drive controller is operated to stop the motor;

wherein said stop controller receives said first stop position signal from said stop position selector to bring the sewing needle to a first position where it is located and stopped adjacent a top dead point in the overedge stitching operation when the motor drive controller is operated to initiate a stoppage of the sewing needle, and wherein said stop controller receives said second stop position signal from said stop position selector for bringing the sewing needle to a second position in substantial coincidence with release of the thread from a point of the lower looper just prior to the sewing needle reaching a bottom dead point during the chain stitching operation when the motor drive controller is operated to initiate a stoppage of the sewing needle.

5. An apparatus according to claim 4, further comprising:

reverse rotation controller for receiving said second stop position signal and for rotating the motor in a reverse direction after the motor is stopped by said stop controller until the sewing needle is returned at or near the top dead point of the sewing needle.

6. An apparatus according to claim 5 wherein said reverse rotation controller includes a timer for providing a predetermined time lag.

7. A method of stopping a sewing machine operating at least one of a double chain stitching operation and a covering chain stitching operation, the sewing machine comprising a sewing needle, a lower looper, a motor for driving the sewing machine and a motor drive controller for controlling the driving and stopping of the motor, said method comprising the step of:

stopping the motor and bringing the sewing needle to a stop position in substantial coincidence with release of the thread from a point of the lower looper just prior to the sewing needle reaching a bottom dead point during the period of time when the motor drive controller is operated to stop the motor.

8. A method of stopping a sewing machine operating at least one of a double chain stitching operation and a covering chain stitching operation, the sewing machine comprising a sewing needle, a lower looper, a motor for driving the sewing machine and a motor drive controller for controlling the driving and stopping of the motor, said method comprising the steps of:

stopping said motor and bringing the sewing needle to a stop position in substantial coincidence with release of the thread from a point of the lower looper just prior to the sewing needle reaching a bottom dead point during the period of time when the controller is operated to stop the motor; and rotating the motor in a reverse direction after the stopping step until the sewing needle is returned at or near the top dead point of the sewing needle.

9. An apparatus according to claim 8, wherein said step of rotating comprises the step of rotating the motor in the reverse direction after the stopping step until the sewing needle is returned near the top dead point of the sewing needle.

10. A method of stopping a sewing machine, the sewing machine comprising a sewing needle, an upper looper, a lower looper, a motor for driving the sewing machine, a motor drive controller for controlling the driving and stopping of the motor, and a selection switch for selecting between an overedge stitching operation performed by driving the sewing needle and the upper and lower loopers and a chain stitching operation including at least one of a double chain stitching operating and a covering chain stitching operation performed by driving the sewing needle and the lower looper, said method comprising the steps of:

providing a first stop position signal to a stop controller from a stop position selector for stopping the sewing needle at a first position adjacent a top dead point in the overedge stitching operation when the motor drive controller is operated to initiate a stoppage of the sewing needle; and providing a second stop position signal to said stop controller from said stop position selector for stopping the sewing needle at a second position in substantial coincidence with release of the thread from a point of the lower looper just prior to the sewing needle reaching a bottom dead point during the chain stitching operation when the motor drive controller is operated to initiate a stoppage of the sewing needle.

* * * * *

UNITED STATES PATENT AND TRADEMARK OFFICE

CERTIFICATE OF CORRECTION

PATENT NO. : 5,537,944
DATED : July 23 1996
INVENTOR(S) : Shiro SATOMA

It is certified that error appears in the above-indentified patent and that said Letters Patent is hereby corrected as shown below:

Claim 4, line 1, delete "(Amended)".

Signed and Sealed this

Second Day of September, 1997

*Attest:*

*Attesting Officer*

BRUCE LEHMAN

*Commissioner of Patents and Trademarks*